US006161743A

United States Patent [19]

Shoemaker, Jr.

[11] Patent Number: 6,161,743

[45] Date of Patent: Dec. 19, 2000

[54] TICKET DISPENSER USING SHARP PINS ON A DRIVER ROLLER TO ADVANCE TICKETS

[75] Inventor: Stephen P. Shoemaker, Jr., Redondo Beach, Calif.

[73] Assignee: Wedges/Ledges, Redondo Beach, Calif.

[21] Appl. No.: 09/328,052

[22] Filed: Jun. 8, 1999

[51] Int. Cl.[7] ..... B65H 20/20; B65H 23/16

[52] U.S. Cl. ..... 226/183; 226/156

[58] Field of Search ..... 226/156, 183, 226/53

[56] References Cited

U.S. PATENT DOCUMENTS

| | | | |
|---|---|---|---|
| 1,249,191 | 12/1917 | Quigley | 226/53 |
| 2,153,214 | 4/1939 | Tondreau | 226/183 X |
| 2,219,650 | 10/1940 | Helsel . | |
| 2,499,699 | 3/1950 | Tinkham | 226/183 |
| 2,584,212 | 2/1952 | Lanegan et al. | 226/156 |
| 2,657,750 | 11/1953 | Webb . | |
| 2,978,161 | 4/1961 | Debrie | 226/183 |
| 3,280,678 | 10/1966 | Shackelford . | |
| 3,627,183 | 12/1971 | Mason . | |
| 3,777,964 | 12/1973 | Kruner et al. | 226/183 |
| 3,985,277 | 10/1976 | Wright | 226/183 X |
| 4,033,494 | 7/1977 | Middleton et al. | 226/156 X |
| 4,086,833 | 5/1978 | Austin, Jr. | 226/156 X |
| 4,185,548 | 1/1980 | Pierce, Jr. et al. | 226/195 |
| 4,272,001 | 6/1981 | Horniak . | |
| 4,790,469 | 12/1988 | Toyota | 226/129 |
| 5,179,892 | 1/1993 | Cicatello et al. | 226/183 X |
| 5,358,072 | 10/1994 | Szatkowski et al. | 226/53 X |
| 5,560,400 | 10/1996 | Meyns et al. | 226/183 X |
| 5,695,107 | 12/1997 | Shoemaker, Jr. | 226/43 X |

*Primary Examiner*—Donald P. Walsh
*Assistant Examiner*—Collin A. Webb
*Attorney, Agent, or Firm*—Hickman Coleman & Hughes, LLP

[57] ABSTRACT

A ticket dispenser includes an adjustable tension device and a driver. The driver includes at least one sharp pin configured to pierce at least a portion of a thickness of a ticket strip and to pull the ticket strip in a direction along a ticket path. The ticket strip passes through the tension device as it is pulled by the driver. The tension device exerts a force on the ticket strip in a direction opposite the pulled direction. The driver can be a roller that is rotated by a motor. In addition, the ticket dispenser includes a driver guide which is adjacent and in close proximity to the driver. The ticket strip passes between the driver guide and the driver, thereby biasing the ticket strip in close proximity to the driver, and facilitating piercing of the ticket strip by the sharp pins. The driver guide includes rollers which have a groove extending around a circumference of the rollers. The sharp pins of the driver are aligned with and pass through the grooves which thereby further facilitate piercing of the ticket strip.

15 Claims, 11 Drawing Sheets

TICKET DISPENSER USING SHARP PINS ON A DRIVER ROLLER TO ADVANCE TICKETS

BACKGROUND OF THE INVENTION

1. Field of the Invention

This invention relates to ticket dispensers, and more particularly to ticket dispensers used in redemption-type arcade games.

2. Background of the Related Art

Ticket dispensers are used wherever tickets can be used as a means for exchange of goods and/or services. For example, amusement parks, theaters, and other public entertainment can use tickets to ensure that customers have paid an admission fee before making use of the entertainment services. In other fields such as public transportation, tickets can provide a similar service.

Another popular field for using tickets and ticket dispensers is the field of arcade games. Players of the arcade games can win redemption tickets based on a final score or goals which were completed during a game. The redemption tickets can be redeemed for prizes offered at the arcade.

In a typical redemption-type arcade game, a ticket dispenser is positioned at a front panel or in a game unit, where players have easy access to dispensed tickets. Generally, a supply such as a roll or fanfold of tickets is stored in a supply cache or compartment near the ticket dispenser within a game unit. The operator of the game can replace tickets when the supply is exhausted. The tickets are routed from the supply, through the ticket dispenser, and to a front opening or slot in the game unit through which the tickets are dispensed. The ticket dispenser may include one or more motor-driven rollers which can move the strip of tickets to and through the slot.

Examples of prior art ticket dispensers can be found in U.S. Pat. No. 3,627,183 to V. Mason, U.S. Pat. No. 2,657,750 to C. F. Webb, U.S. Pat. No. 2,219,650 to R. H. Helsel, and U.S. Pat. No. 3,280,678 to W. T. Shackelford.

A ticket dispenser typically used in arcade games is manufactured by Deltronic Labs, Inc. (U.S. Pat. No. 4,272,001). With the Deltronic dispenser, a ticket strip is routed from a supply to the back of the dispenser, through a sensor, through a set of pinch rollers, and out a dispensing slot in the game unit. The pinch rollers push the tickets along the ticket path and out the dispensing slot. Such a ticket dispenser is also configured to help impede a game player from pulling non-dispensed tickets from the game unit. For example, the pinch rollers can be on a wedge slide, such that when a ticket is attempted to be pulled out the slot by a game player, the pinch rollers grab the ticket more tightly in proportion to the pulling force to prevent any tickets from being pulled.

Although typical tickets used are made of heavy card stock, use of less stiff thin tickets may be more desirable. For example, tickets having a thickness similar to 20 lb. paper and a width of about one half of an inch can be used. Such tickets may be more desirable because only a certain amount of tickets may be stored at one time in the ticket supply space in the game unit, and the amount of tickets stored depends on the width and thickness of each ticket. With thinner tickets, more tickets can be stored for the dispenser in a given amount of space. This benefit is magnified as the number of tickets typically dispensed and redeemed increases. With additional features added to redemption arcade games, such as progressive bonus features, and prizes of greater worth often offered to customers, very large numbers of tickets can be dispensed to players in a single game and over many games played on a redemption arcade game unit. For example, an arcade game unit including a progressive feature can accumulate and then dispense a ticket award of 1000 or more tickets.

Using the ticket size of the prior art in conjunction with such ticket dispensing, an operator must continuously refill the ticket supply cache as tickets run out, incurring additional labor expense. The operator's cost for purchasing large numbers of such tickets also can get exceedingly high. Thus, use of thinner tickets can result in lower operating costs. In addition, because the resulting large numbers of tickets can be more easily counted using accurate scales, the tickets do not need to be thicker to accommodate manual counting of each individual ticket. A description of an example of such thin tickets can be found in U.S. Pat. No. 5,695,107 to S. P. Shoemaker, Jr., the specification of which is included herein by reference.

Unfortunately, because of the amount of tension typically imparted by the pinch rollers on the tickets to advance the ticket strip, the ticket strip can be torn, crumpled, or otherwise mutilated within the ticket dispenser. This can additionally result in jamming or misfeeding of the ticket dispenser. Further, the likelihood of such destruction of the ticket strip and resulting disruption of the ticket dispenser can be greater with decreasing thickness of the tickets.

To reduce such problems, a ticket dispenser using a knurled drive roller with one or more pressure rollers can be used instead of pinch rollers to progress a ticket strip along a ticket path between the ticket supply to the game unit ticket outlet. An example of such a ticket dispenser can be found in U.S. Pat. No. 5,695,107 to S. P. Shoemaker, Jr., the specification of which is herein incorporated by reference. Such a ticket dispenser produces less tension on a thin ticket strip, thereby causing less tearing, jamming, and misfeeds.

However, a ticket dispenser is desired that further reduces the likelihood of ticket damage and disruption of the ticket dispenser, including when used with thin tickets. In particular, a ticket dispenser is desired which imparts less tension on a ticket strip than in the prior art devices, in order to allow an increase in a speed with which tickets may be dispensed. Also, it is desired that the ticket dispenser include a simple, inexpensive braking mechanism to inhibit a game player from pulling one or more tickets from the ticket dispenser.

SUMMARY OF INVENTION

The present invention provides an improved ticket dispenser. The ticket dispenser of the present invention is suited to dispense tickets with less tension, and therefore less likelihood of ticket damage and dispenser disruption and increased speed.

In an embodiment of the present invention, a ticket dispenser for outputting tickets through an outlet of an apparatus includes a base having a first end and a second end, wherein the second end can be disposed near the outlet of the apparatus. A tension device is disposed near the first end of the base and configured to frictionally engage a ticket strip when the ticket strip is moved through the tension device. The ticket dispenser also includes a driver disposed near the second end of the base, the driver having at least one sharp protrusion. The driver is configured to rotate independently from the base and to engage and move the ticket strip away from the tension device along a ticket path. Also, the sharp protrusion is configured to pierce at least a portion of a thickness of the ticket strip when the driver engages the ticket strip.

In another embodiment of the present invention, a method for dispensing a ticket strip from an apparatus includes creating tension in a ticket strip and engaging the ticket strip by piercing the ticket strip at at least one pierced point. Also, the method includes translating the pierced point along a ticket path, wherein the translation contributes to creating tension in the ticket strip.

In yet another embodiment of the present invention, a ticket dispenser for dispensing a ticket strip from an apparatus includes means for creating tension in the ticket strip and means for engaging the ticket strip, including means for piercing the ticket strip at at least one pierced point. The ticket dispenser also includes means for translating the pierced point along a ticket path, wherein the translation contributes to creating tension in the ticket strip.

By using at least one sharp pin to engage and move the ticket strip, less force is needed to pull the ticket strip along the ticket path. Also less tension in the ticket strip is needed. Therefore, the tension in the ticket strip can be minimized by imparting less force in the tension device, and by other techniques. With reduced tension on the ticket strip, the likelihood of separating, tearing, ripping, or otherwise damaging the ticket strip, and of jamming the ticket dispenser, is reduced. Further, the piercing of each ticket that is engaged by a sharp pin can render such tickets identifiable as having been dispensed. This can aid operators of the apparatuses who desire to redeem only dispensed tickets.

These and other advantages of the present invention will become apparent to those skilled in the art after reading the following descriptions and studying the various figures of the drawings.

DETAILED DESCRIPTION OF THE PREFERRED EMBODIMENTS

The improved ticket dispenser of the present invention can be used for a variety of applications that require tickets to be used for exchange of goods and/or services. For example, the ticket dispenser can be used for entertainment purposes, as in movie theaters, amusement parks, and the like; transportation services, such as a train, bus, etc.; and so on. The present invention, however, is particularly well-suited to games, specifically arcade redemption-type games that provide tickets as a non-monetary award to players of the games. It is with this application in mind that the several embodiments of the present invention are described.

Figure 1:
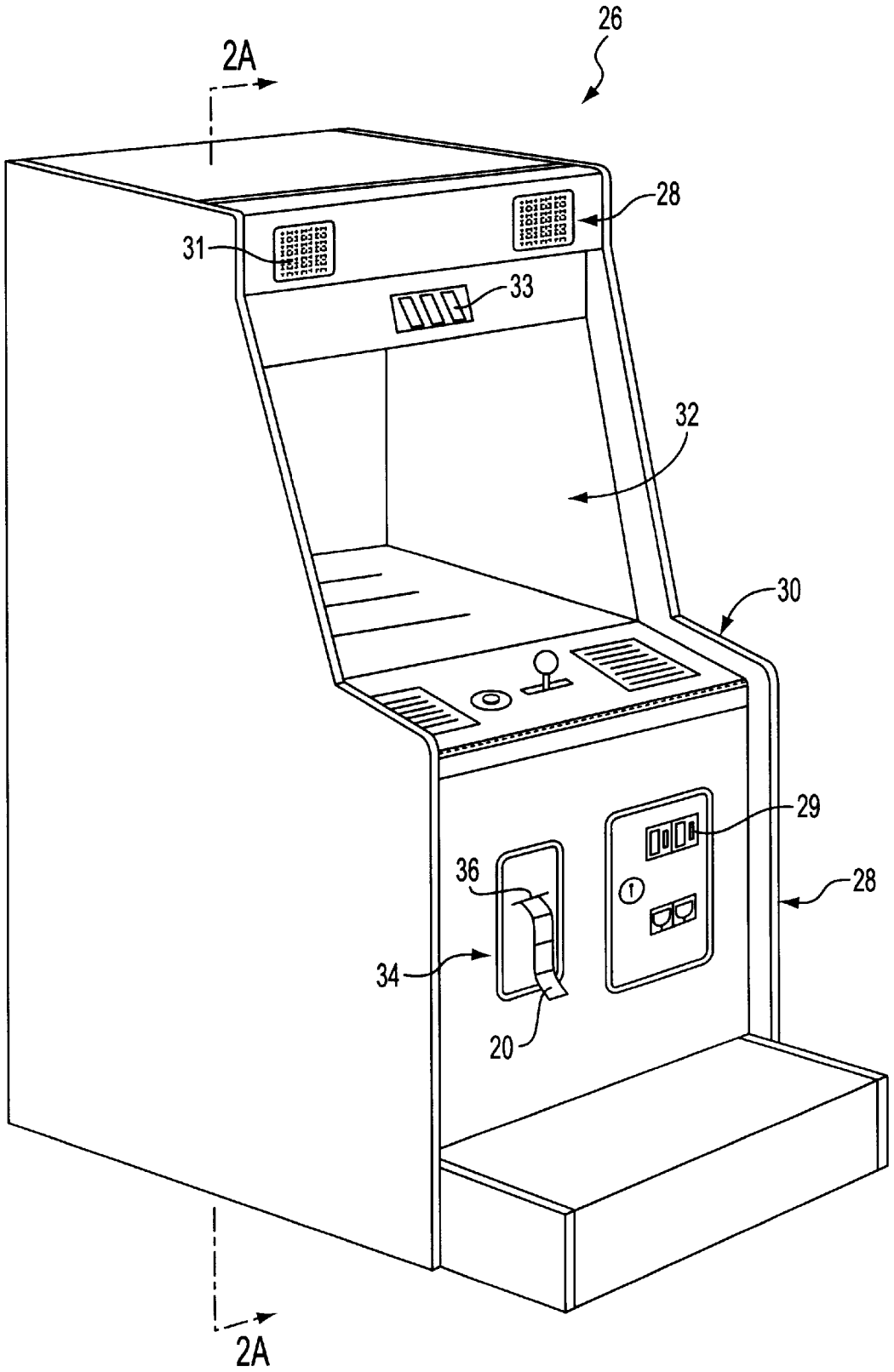
FIG. 1 is a perspective view of a redemption-type game apparatus suitable for use with the ticket dispenser of the present invention.

FIG. 1 is a perspective view of an example of a generic arcade redemption-type game apparatus 26 suitable for use with the ticket dispenser of the present invention. Such game apparatuses are well-known to those skilled in the art and can take a wide variety of forms, with apparatus 26 being just one example. Game apparatus 26 typically includes a front panel section 28, player controls 30, and a playing area 32.

Front panel section 28 can be positioned below the player controls 30, as shown in FIG. 1. The front panel section can also be positioned in a wide variety of other locations, such as above playing area 32, to the side of the playing area or player controls, etc. Front panel section 28 may include a coin deposit slot 29, speakers 31, and a ticket dispenser 34.

Coin deposit slot 29 typically accepts standard currency coins, game tokens, or bills that are often available in an arcade environment. A coin deposited in coin deposit slot 29 starts a game. A playing piece may be released for the player to use during the game, player controls may be activated to allow a player to play the game, etc. Speakers 31 emits sounds based on game actions and other game states and is controlled by a game unit controller system, as is well known to those skilled in the art. Ticket dispenser 34 of the present invention dispenses a ticket award to the player based upon the results of a game, and is described in greater detail subsequently. The front panel 28 can also include other features, such as a playing piece dispenser, if appropriate.

Player controls 30 allow a player to manipulate events in the game, and typically include a joystick, buttons, a knob, or the like. Game action occurs in playing area 32, where, for example, a playing piece, video image, or other game object may be controlled and/or guided by the player on a field, video screen, etc. to achieve a goal. Once the goal is achieved, a game score is typically increased. The game score can be displayed on a display 33. Some games also include a progressive bonus score, which is a score contributed to by multiple connected game units. Depending on the game, a player may get multiple chances to play with one coin, or the player may have to insert additional coins.

When a game is over, ticket dispenser 34 dispenses an amount of tickets 21 to the player through an outlet 36 in the ticket dispenser. Alternatively, the tickets can be dispensed during a game, if desired. These tickets are preferably in the form of a ticket strip 20 as shown in FIG. 1. A ticket, as used herein, includes any object that can be exchanged for goods and/or services. Further, the ticket can be formed of any suitable material, for example paper, cardboard, or plastic. The number of dispensed tickets can be based upon the results of the game, and is typically based on the final game score displayed on display 33 or another display to which the game 26 is connected. For example, one ticket can be dispensed for every 5 points of game score, 2 points of game score, 0.1 points of game score, or any amount that the operator of the game apparatus desires. If a progressive feature is being implemented in game apparatus 26, the number of dispensed tickets can be based on the progressive score, for example if a progressive task was completed by the player during the game. The dispensed tickets 21 may be accumulated by a player and redeemed to win various prizes. In general, the greater the worth of the prize desired, the more tickets are needed to be exchanged for that prize. The ticket dispenser 34, game score display 33, player controls 30, and other functions of the game apparatus 26 can be controlled by a control system (see FIG. 5). In the alternative, the ticket dispenser 34 may be controlled by a cash register for dispensing stamps, i.e. blue chips, green stamps, etc.

Figure 2A:
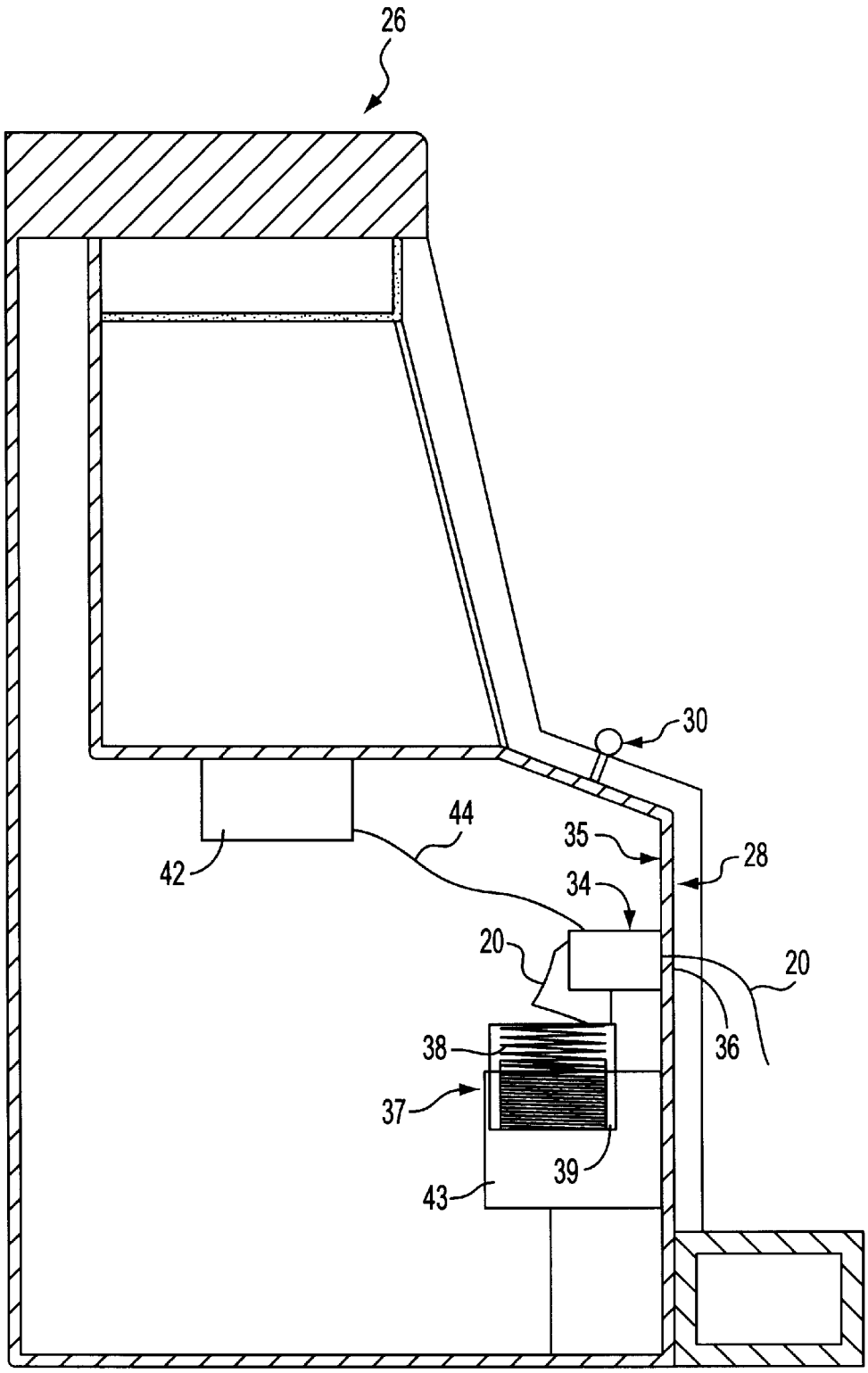
FIG. 2A is a side cross-sectional view of an alternate embodiment of the game apparatus taken along line 2—2 shown in FIG. 1.
Figure 2B:
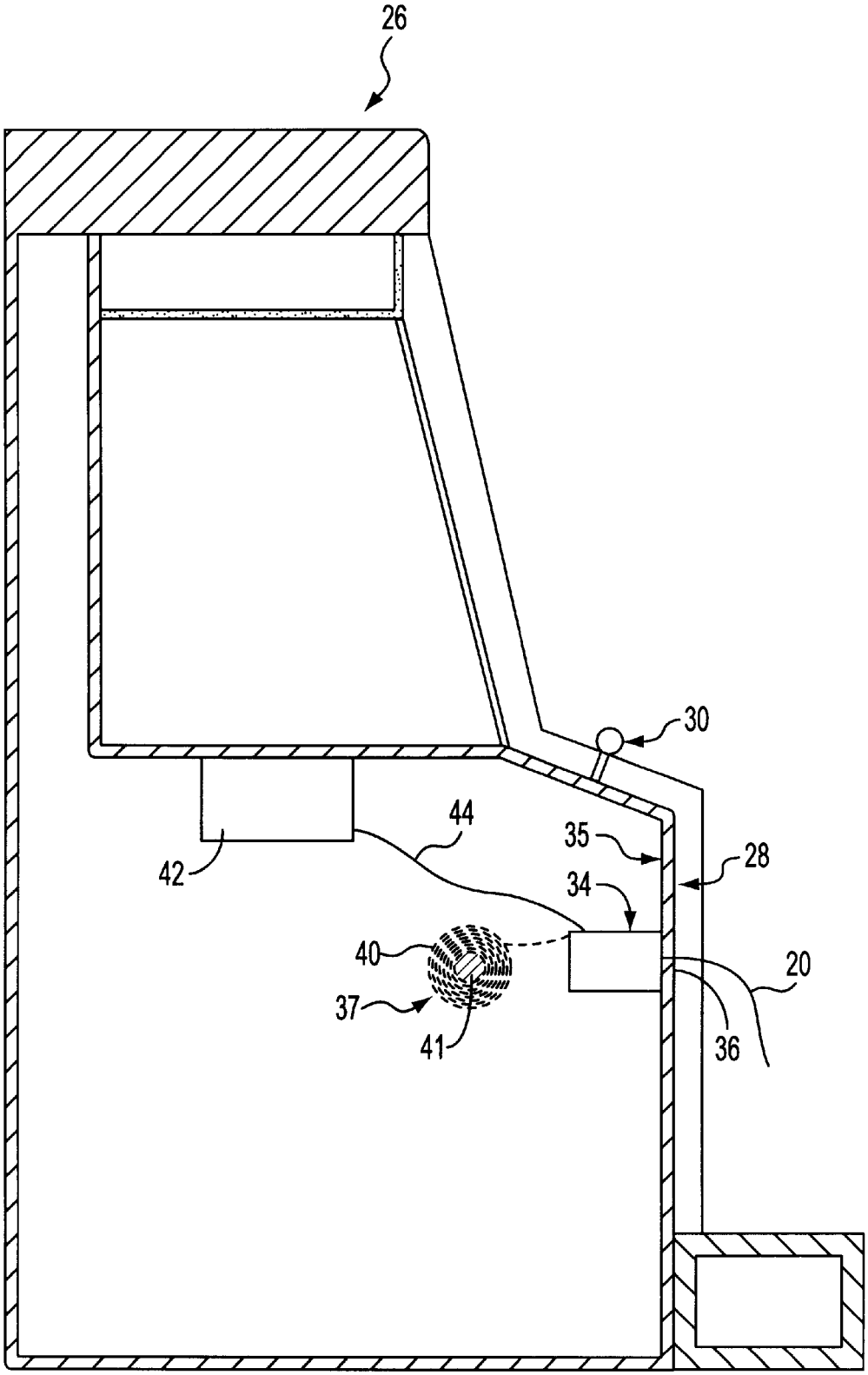
FIG. 2 is a side cross-sectional view of the game apparatus taken along line 2—2 of FIG. 1.
Figure 4A:
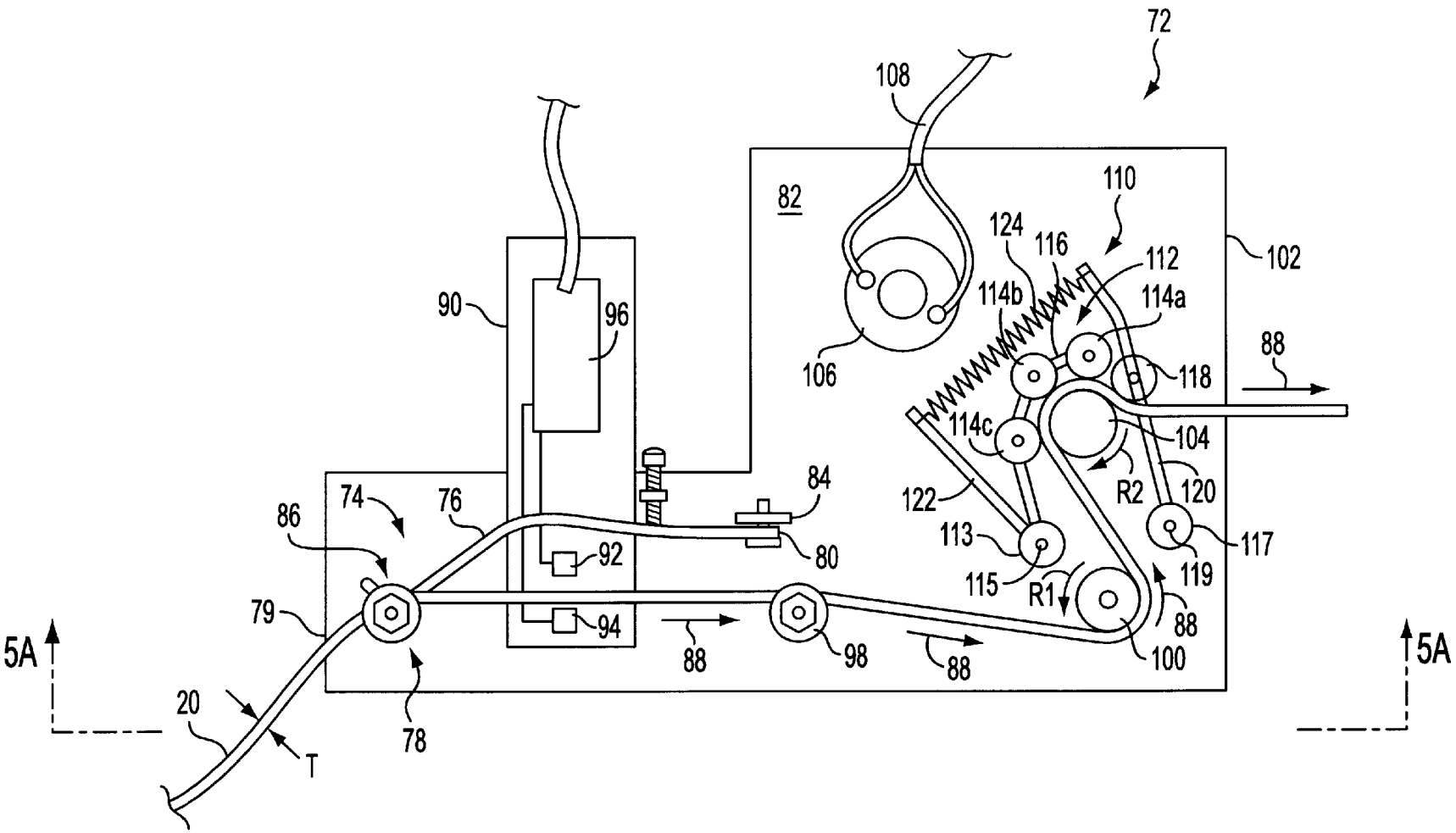
FIG. 4*a* is a side view of an alternate embodiment of the present invention.
Figure 4B:
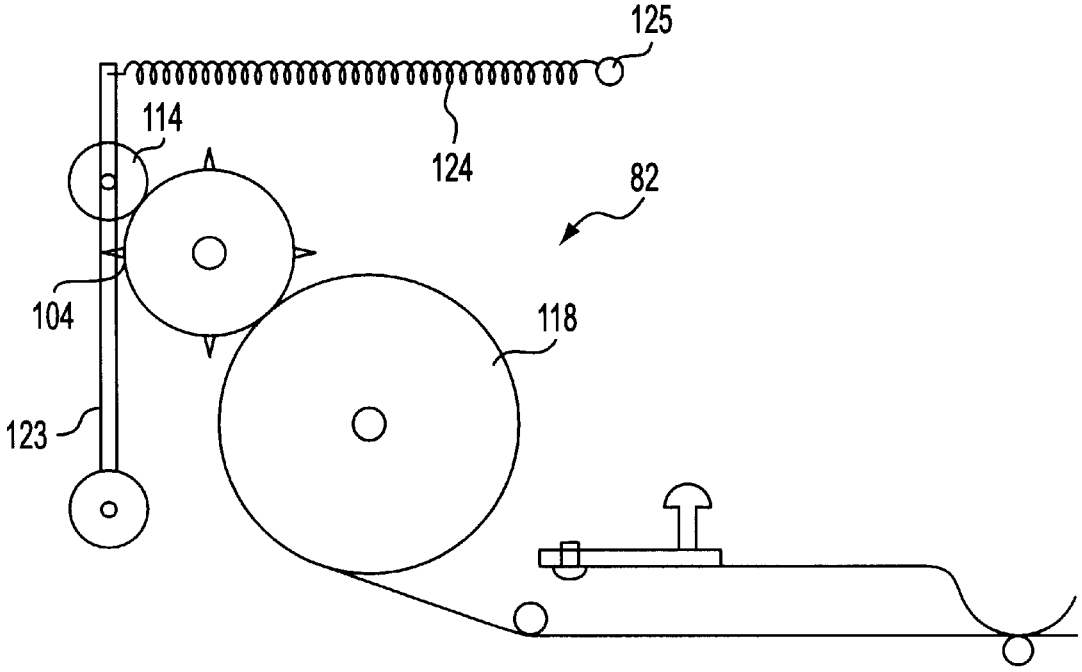
FIG. 4*b* is a top view of the alternate embodiment of the present invention shown in FIG. 4*a;*
Figure 4C:
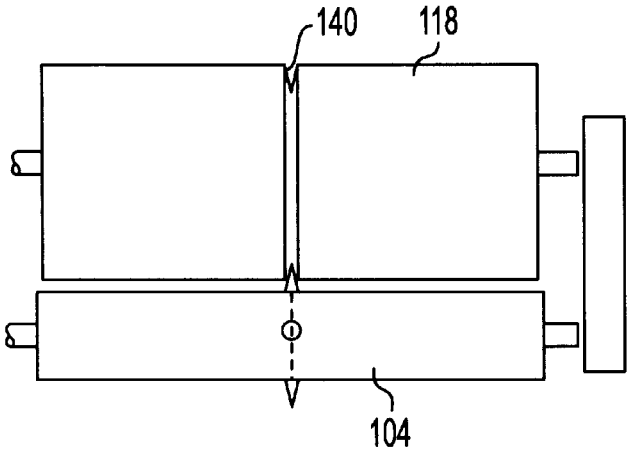
FIG. 4 is a side view of a ticket dispenser, according to an embodiment of the present invention.

FIG. 2 is a side cross-sectional view of game apparatus 26 along line 2—2 of FIG. 4 to show the interior of game apparatus 26. Interior components specific to the mechanics and implementation of game play are not shown and are well known to those skilled in the art. Ticket dispenser 34 is positioned behind front panel 28 and can be coupled to a back side 35 of front panel 28. Dispensed ticket strip 20 is routed through outlet 36, which is an aperture in front panel 12. Of course, the ticket dispenser 34 can alternatively be positioned elsewhere within, on, or outside the game apparatus 26, and dispensed ticket strip 20 can alternatively be routed through an outlet located elsewhere on or outside the game apparatus 26.

Ticket strip 20 originates from a supply 37 of tickets positioned in the interior of game apparatus 26. Alternatively, the supply 37 can be located outside the game apparatus 26, although preferably out of the reach of game players. The supply 37 can be a fan-fold 38 of ticket strip 20 which is stored in a box 39 or similar container positioned below and/or to the rear of ticket dispenser 34. Ticket strip 20 in fan-fold 34 is folded in a criss-cross pattern after each X amount of tickets 24, where X is a number such as 10, 20, etc. Ticket strip 20 naturally unfolds as it is fed through ticket dispenser 34.

Alternatively, supply 37 of ticket strip 20 can be provided as a roll 40. Note FIG. 2A. Roll 40 includes a rotating spindle 41 or a similar member around which tickets 20 are wrapped. As the tickets are fed through dispenser 34, roll 40 rotates to unravel additional tickets. Roll 40 can be positioned to the rear or below ticket dispenser 34 in a box similar to box 39, for example.

Ticket dispenser 34 can also be coupled via a bus 44 to main control system 42, which controls the operation of ticket dispenser 34 and other components of the game apparatus 26. Control system 42 can be positioned in a wide variety of places, for example within game apparatus 26, and is shown positioned under playing area 32 as a specific example. Control system 42 can include a number of electronic components on a circuit board or similar substrate.

Also typically included in the interior of game apparatus 26 is a coin box 43. Coin box 43 can be positioned in the interior of the game apparatus 26 near the front panel 28 to store coins or other monetary input that have been inserted in coin deposit slot 29.

Figure 3:
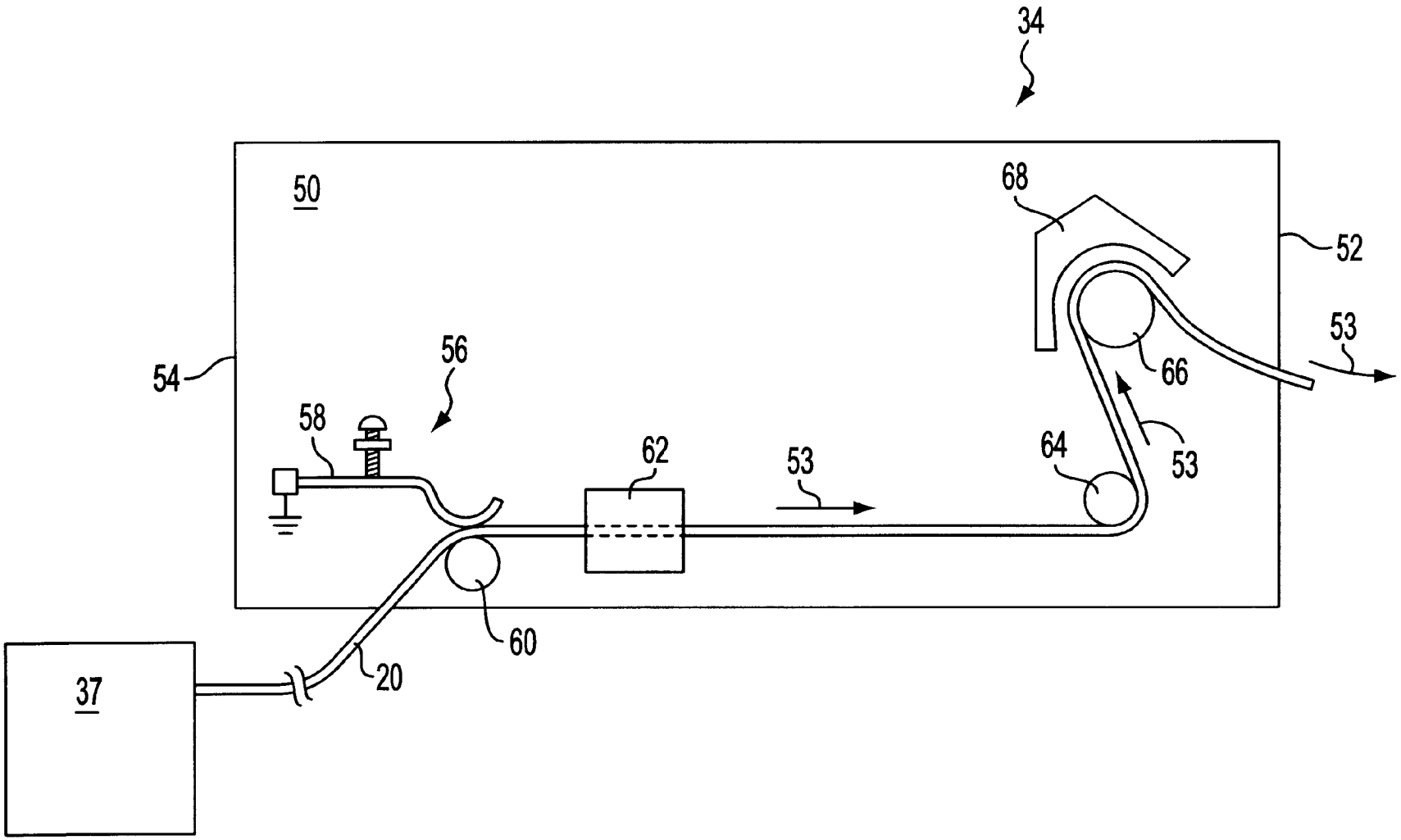
FIG. 3 is a schematic view of a ticket dispenser, according to an embodiment of the present invention.

FIG. 3 is a schematic view of the ticket dispenser 34 of the present invention. A ticket strip 20 is moved along a ticket path, indicated by arrows 53. Ticket supply 37 provides ticket strip 20 as described with reference to FIG. 2. The ticket dispenser 34 of the present invention is well suited to dispense thinner, smaller tickets, such as formed of 20 lb. or thinner paper. However, the ticket dispenser 34 can also dispense other types of tickets, such as the thicker tickets of the prior art.

The ticket dispenser 34 includes a base 50 having a front end 52 and a rear end 54. A tension device 56 is disposed near the rear end 54 and connected to the base 50. The tension device 56 includes an adjustable, flexible tension spring 58 that is aligned with and presses toward a rear guide 60. The rear guide 60 can have a curved surface and have, for example, a cylindrical shape. The rear guide 60 can be fixedly attached to the base 50, or can be free to rotate about a spindle that is fixedly attached to the base 50. The ticket strip 20 can pass through the tension device 56, between the flexible tension spring 58 and the rear guide 60. When the ticket strip 20 is drawn through the tension device 56 along the ticket path 53, the friction between the tension device 56 and the ticket strip 20 is a force that operates on the ticket strip 20 in a direction that is substantially opposite the direction of movement of the ticket strip, thereby creating a tension in the ticket strip 20.

The ticket dispenser 34 also includes a sensor 62 that is disposed adjacent the ticket path 53. The sensor 62 can be used to detect each individual ticket that comprises the ticket strip 20, as it passes by the sensor 62. The sensor 62 is described in further detail below with respect to FIG. 4. Alternatively, other techniques can be used to detect each individual ticket, without including the sensor 62.

A front guide 64 is also included near the front end 52 of the ticket dispenser 34. The ticket strip 20 can pass around the front guide 64, which can have a curved surface, and, for example, a cylindrical shape. The front guide 64 can be a cylindrical roller which is rotatably connected to the base 50. Thus, as the ticket strip 20 passes along the ticket path 53, the front guide 64 can turn due to frictional forces between the ticket strip 20 and the front guide 64. Thus, with such rotation a reduced amount of drag is imparted to the ticket strip 20 by the front guide 64. With less drag, less tension is caused in the ticket strip 20, which can reduce the likelihood of the ticket strip 20 tearing. Such decrease in drag further translates into less friction which in turn affords an increase in the speed of dispensing.

The ticket strip 20 can also pass around a driver 66 disposed near the front end 52 of the ticket dispenser 34. As is described further below with reference to FIG. 6, the driver 66 is configured to engage and move the ticket strip 20 along the ticket path 53. To accomplish this, the driver 66 is rotatably fixed to the base 50 and connected to a motor (see FIG. 4 and related discussion below) by which it turns. The motor connected to the driver 66 can be located near the driver 66, for example affixed to the base 50. As an alternative, the motor can be disposed at a distance from the driver 66 and connected through various known mechanical connections.

A driver guide 68 is disposed near the driver 66. The ticket strip 20 can pass between the driver 66 and the driver guide 68. To assist movement of the ticket strip 20 along the ticket path 53, the driver guide 68 remains in substantially close proximity to the driver 66 during movement of the ticket strip 20. After passing between the driver 66 and the driver guide 68, the ticket strip 20 passes along the ticket path 53 to an outlet of the game or other apparatus with which the ticket dispenser 34 is associated.

FIG. 4 is a side view of a ticket dispenser 72, according to an embodiment of the present invention. A tension device 74 includes a tension spring 76 and a rear guide 78. The tension spring 76 has a fixed end 80 that is fixed to the base 82 by a coupling means. For example, the fixed end 80 of the tension spring 76 can be connected by a screw to a stand 84 that extends from and is soldered to the base 82. Of course, the fixed end 80 of the tension spring 76 can alternatively be fixedly connected to the base 82 by other means known to those skilled in the art. A free end 86 of the tension spring 76 is aligned with and presses toward the rear guide 78. The rear guide 78 can have a curved surface adjacent the tension spring 76, and can have a cylindrical shape, for example. The rear guide 78 is connected to the base 82, and can be either fixed or free to rotate about a spindle that is fixedly connected to the base 82.

The ticket strip 20 can pass between the tension spring free end 86 and the rear guide 78 with a resulting tension as described above with reference to FIG. 3. As an option, a screw may be employed to increase or decrease tension between the free end 86 of the tension spring 76 and the ticket strip 20 in order to accommodate tearing of tickets having different strengths and thickness. Additional detail regarding such screw will be set forth hereinafter during reference to FIG. 9. As the ticket strip 20 passes through the ticket dispenser 72, the ticket strip 20 follows a particular ticket path 88. Along this path, a sensor 90 is disposed adjacent the ticket path 88, and therefore adjacent the ticket strip 20. The sensor 90 can alternatively be disposed along the ticket path 88 at substantially any other point than that shown in FIG. 4. The sensor 90 can include an emitter 92 and a detector 94. The emitter 92 and the detector 94 can be connected to an integrated circuit 96, or other controller. The emitter 92 and the detector 94 are disposed on either side of the ticket path 88 and substantially aligned with each other. For a more clear understanding, the operation of the sensor 90 is further discussed below with reference to FIG. 5.

A mid-path guide 98 is also included in the ticket dispenser 72, affixed to the base 82. The ticket strip 20 passes around the mid-path guide 98 as the ticket strip 20 passes along the ticket path 88. The mid-path guide 98 can have a curved surface over which the ticket strip 20 passes, and can be of a cylindrical shape, for example. With the curved surface of the rear guide 78 and the mid-path guide 98, less drag is imparted to the ticket strip 20 by these elements. Further, one or both of the rear guide 78 and the mid-path guide 98 can be rotatable about a spindle affixed to the base 82, further reducing the drag imparted to the ticket strip 20. With reduced drag, the tension in the ticket strip 20 can be minimized, thus reducing the likelihood of the ticket strip 20 tearing, ripping, or being otherwise damaged.

A front guide 100 is rotatably or fixedly attached to the base 82 near the front end 102 of the base 82. The front guide 100 can have a curved outer surface over which a ticket strip 20 passes along the ticket path 88. For example, the front guide 100 can have a cylindrical shape, and rotate in the direction indicated by the arrow R1 as the ticket strip 20 moves along the path 88. In the alternative, front guide 100 may be designed to remain fixed. Also connected to the base 82 near the front end 102, is a driver 104 around which the ticket strip 20 passes. In one embodiment, driver 104 is constructed at least in part from nylon. The driver 104 is rotatably attached to the base 82, and coupled to a motor 106 that is likewise coupled to the base 82. Of course, the motor 106 can be alternatively located elsewhere with relation to the base 82, while being connected to the driver 104. As will be discussed further with reference to FIG. 5, operation of the motor 106 can cause the rotation of the driver 104 in the direction of the arrow R2. Operation of the motor can be controlled by an integrated circuit or other controller (not shown) to which the motor 106 is connected by electrical connections 108. Interaction between the driver 104 and the ticket strip 20 is further described below with reference to FIGS. 6 and 7.

The ticket dispenser 72 further includes a driver guide 110. The driver guide 110 includes a roller assembly 112 that is disposed substantially near the driver 104 during operation of the ticket dispenser 72. The roller assembly 112 includes rollers 114*a*, 114*b*, and 114*c* arranged around the circumference of the driver 104, for about 30 degrees to about 180 degrees of the circumference. In one embodiment, rollers 114*a*, 114*b*, and 114*c* are constructed at least in part from nylon. The rollers 114*a–c* are shown attached to a roller assembly arm 116. The roller assembly arm 116 can fixedly connect each of the rollers 114*a–c* to each other. The roller assembly arm 116 is connected to the base 82. As shown, the roller assembly arm 116 can be fixedly attached to an assembly arm post 113 that is free to rotate about an assembly arm post spindle 115 that itself is fixedly attached to the base 82. Alternatively, one or more of the rollers 114*a–c* can be otherwise connected to the base 82. For example, each of the rollers 114*a–c* can be individually, rotatably connected to the base 82.

The driver guide 110 further includes an output roller 118 which is disposed adjacent the circumference of the driver 104, along the ticket path 88 beyond the roller assembly 112. In one embodiment, output roller 118 is constructed at least in part from nylon. The output roller is also connected to the base 82. In the specific embodiment shown, the output roller 118 is rotatably attached to a first arm 120 that is fixedly attached to a output roller post 117. In turn, the output roller post 117 is free to rotate about an output roller post spindle that is fixedly connected to the base 82. During operation, the output roller 118 is disposed substantially near or in abutment with the driver 104, as are the rollers 114*a–c*. With such relative placement, the driver guide 110 (see FIG. 4) facilitates the movement of the ticket strip 20 with a surface 138 (see FIG. 6) of the driver 104 as the driver 104 rotates. In one embodiment, output roller 118 and roller 114*c* remain in abutment with the driver 104 while rollers 114*a* and 114*b* remain substantially near the driver 104. Rollers 114*a* and 114*b* thus preclude the ticket strip 20 from escaping the driver 104. Further, output roller 118 and roller 114*c* may be positioned 180 degrees with respect to each other such that minimum or no stress is applied to motor 116 and enough pressure is applied to the ticket strip 20 for piercing purposes as will become apparent hereinafter.

A second arm 122 is fixedly attached to the assembly arm post 113 and further connected to the first arm 120 by a compression spring 124. During normal operation of the ticket dispenser 72, the compression spring 124 operates to maintain the rollers 114*a–c* and the output roller 118 substantially near or in abutment with the driver 104. However, the compression spring 124 allows for the rotation of the first and or second arms 120, 122 to move the output roller 118 or rollers 114*a–c*, respectively away from the driver 104. This may be desirable for initially feeding a ticket strip 20 between the driver 104 and the driver guide 110. Such movement can also be desirable to remove tickets or any other material that may be between the driver 104 and the driver guide 110, throughout operation of the ticket dispenser 72. In other embodiments of the present invention, the output roller 118 and the associated first arm 120 are not included. Further, while the compression spring 124 can then alternatively be attached to both the second arm 122 and fixed to the base 82, the compression spring 124 and second arm 122 may also be not included. In such a case, other methods known to those skilled in the art can be used for the movement of the driver guide away from the driver 104 or vice versa.

FIGS. 4*a* and 4*b* are illustrations of an alternate embodiment of the present invention. As shown, the instant embodiment includes a single arm 123 and a single roller 114 attached thereto. The single arm 123 is rotatably coupled to the base 82 and is biased by compression spring 124 which is coupled to post 125 protruding from the base 82. Associated therewith is an output roller 118 rotatably coupled to the base 82 and positioned substantially near the driver 104 in order to afford less stress on the driver 104. In the present embodiment, the output roller 118 has a width substantially similar to that of the driver 104. Note FIG. 4*b*. Further, the single output roller 118 rotates about an axis that is fixed with respect to an axis about which the driver 104 rotates. It should be noted that the output roller of the present embodiment may be equipped with a concentric groove 140 similar to that of the rollers 114*a–c* of the previous embodiment.

Figure 5A:
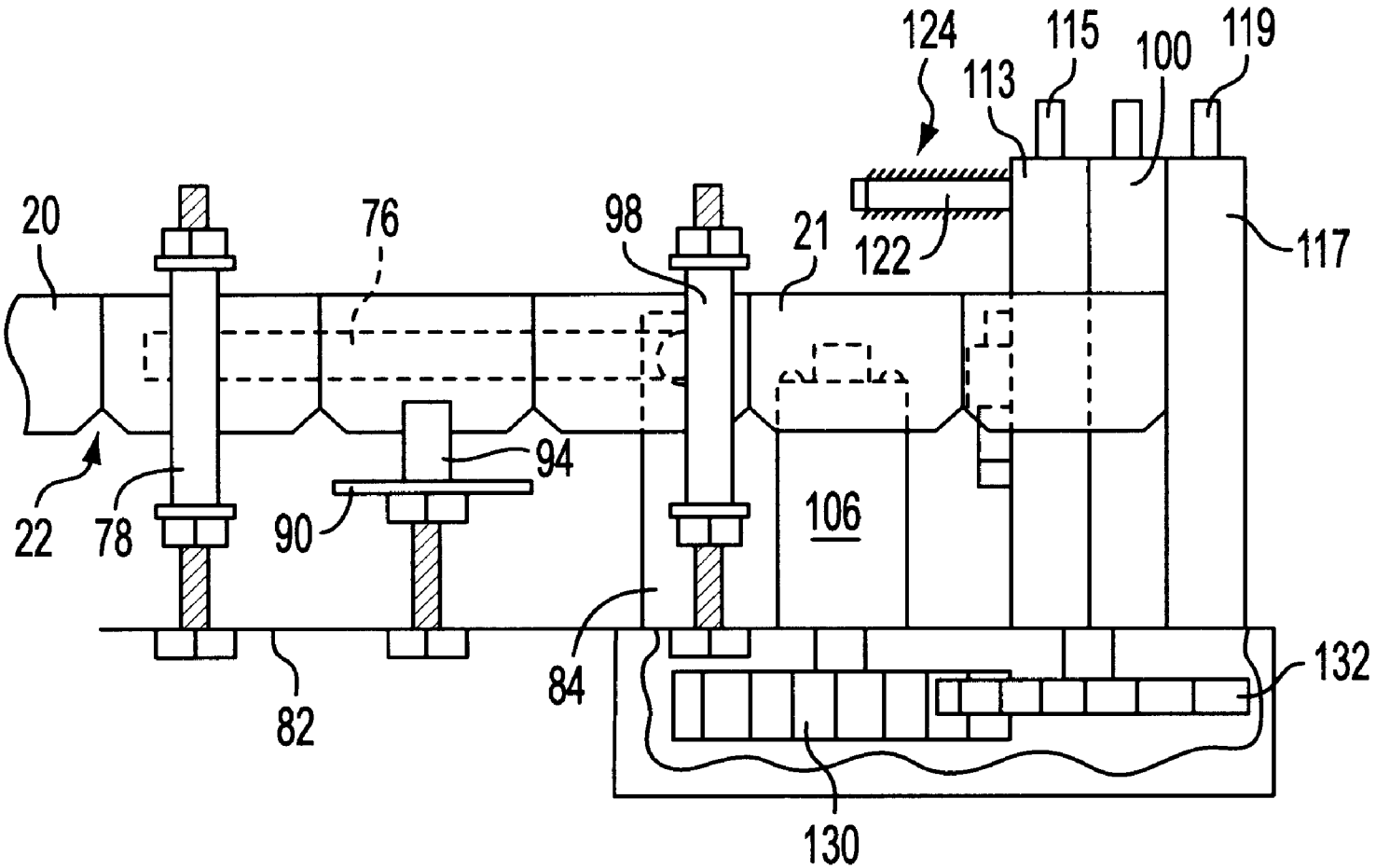
FIG. 5*a* is a side view of an alternate embodiment of the present invention.
Figure 5B:
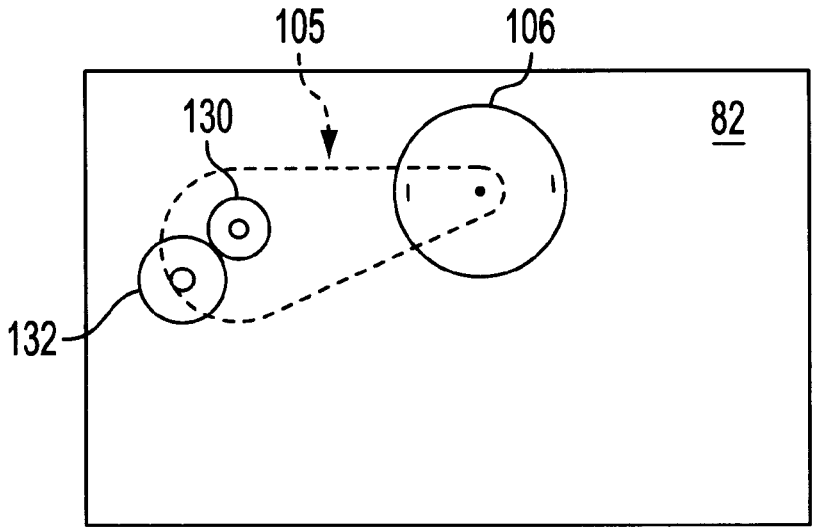
FIG. 5*b* is a top view of the alternate embodiment of the present invention shown in FIG. 5*a;*
Figure 5C:
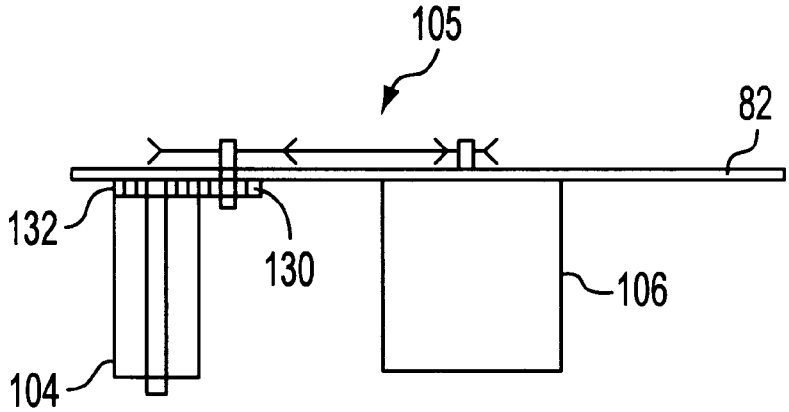
FIG. 5 is a bottom view of the ticket dispenser along line 5—5 of FIG. 4, according to an embodiment of the present invention.

FIG. 5 is a bottom view of the ticket dispenser 72 taken along line 5—5 of FIG. 4. As it moves along the ticket path 88, the ticket strip 20 passes between the rear guide 78 and the tension spring 76, and then passes the sensor 90. The emitter 92 (see FIG. 4) can emit electromagnetic energy, for example in the visible or infrared wavelengths, which the detector 94 can sense. However, when an object, such as the ticket strip 20, passes between the emitter 92 and the detector 94, the detector 94 may sense a different amount of emission than without an intervening object. Thus, when a ticket strip 20 includes periodic voids or notches 22, the detector 94 can sense a different amount of energy from the emitter 92 as the voids pass by the sensor 90. For example, the detector 94 may sense the energy from the emitter 92 only when a void or notch 22 passes between the emitter 92 and the detector 94. The integrated circuit 96 or other controller can control the emissions of the emitter 92. In addition, the integrated circuit 96 can register the sensing of the detector 94. When the location and or frequency of the notches or void in a ticket strip 20 are known, such registering of the detector 94 sensing can be used by the integrated circuit 96 or other controller to determine the number of ticket that have passed by the sensor 90. Typically in normal operation, the number of tickets that pass by the sensor 90 will correspond to the number of tickets output to an operator of the game apparatus. Thus, the sensing by the detector 94 can be used to control the number of tickets dispensed from the ticket dispenser 72. Of course, other types of sensors can be used in place of the above describe sensor 90. For example, a sensor which can detect particular markings included in or on the ticket strip 20, can be used. Also, although the sensor 90 is shown disposed along the ticket path 88 past the tension mechanism 74, the sensor 90 can be otherwise located elsewhere along the ticket path 88.

The ticket strip 20 further passes over the mid-path guide 98 and around the front guide 100. As can also be seen from this view, the ticket strip 20 can include multiple individual tickets 21 connected together in a series. Also shown in FIG. 5 is a motor gear 130 that is fixedly attached to the motor 106. A driver gear 132 is similarly affixed to the driver 104. Both the motor gear 130 and the driver gear 132 are free to rotate relative to the base 82. Further, the gears are positioned and sized such that they can engage one another. Thus, during operation of the motor 106, the motor gear 130 can be turned and, by engaging the driver gear 132, rotate both the driver gear 132 and the driver 104.

FIGS. 5*a* and 5*b* illustrate an alternate embodiment wherein the motor gear 130 and driver gear 132 are supplemented with a belt and pulley system 105 in order to allow the driver 104 to be positioned closer to a ticket strip outlet 36. In still yet another embodiment, a worm gear may be employed which has inherent braking capabilities the importance of which will now be set forth.

The motor 106 can also include a brake mechanism which can resist pulling of the ticket strip 20 through the ticket dispenser 72 from outside the ticket dispenser 72. For example, the motor can be configured to rise along its axis of rotation when the ticket strip 20 is pulled, and thereby contact a brake which retards the motor rotation. This and other methods for braking the motor upon pulling of the ticket strip can be included according to techniques and systems well known to those who are skilled in the art of braking motors. In one embodiment, the motor 106 may include a permanent magnet DC drive. As such, upon grounding both terminals of the motor, a slight braking action is afforded.

Figure 6:
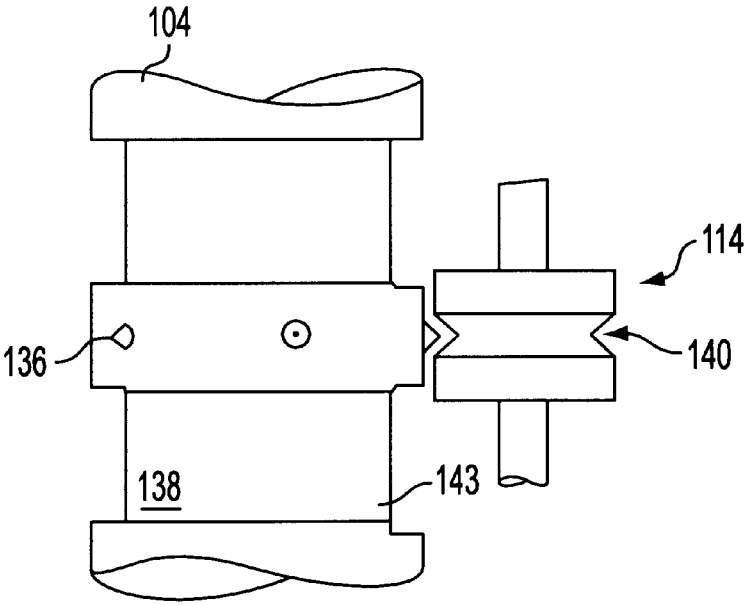
FIG. 6 is a detail view of a drive roller of a ticket dispenser, according to an embodiment of the present invention.

FIG. 6 shows an enlarged view of the driver 104 and one of rollers 114*a* and 114*b*. The driver 104 can have a substantially cylindrical shape with one or more pins 136 protruding from the surface 138 of the driver 104. For example, the driver can include four pins, with the maximum number of pins being influenced by the size of the pin and the circumference of the driver. The pins 136 can have a height that is suitable for piercing the ticket strip. For example, a height of about 2 mm can work will with a ticket strip formed of 20 lb. paper. The pins 136 are shown to have a substantially conical shape with a substantially pointed distal end. However, any suitable shape of pin 136 having a substantially sharp distal end can be used. With such a sharp distal end, the pins 136 can pierce at least a portion of a thickness T (see FIG. 4) of the ticket strip 20 as it passes around the driver 104. Such piercing can include deforming at least a portion of the thickness T, breaking through at least a portion of the thickness T, or both, at the point of contact with a pin 136. For example, the ticket so pierced can be substantially permanently so deformed or broken through. Thus, the pins 136 can engage and pull the ticket strip 20 through the ticket dispenser 72 at a rate significantly faster than tickets dispensers of the prior art. This operation of the pins 136 additionally can provide a security measure for operators. In particular, individual tickets which have passed through the ticket dispenser 72 and have therefore been at least partially punctured by the pins 136, are thereby visibly indicated as having been dispensed from a ticket machine and therefore used. Thus, a game operator can use such puncture marks in the tickets to verify that a ticket has been indeed been dispensed from a game apparatus by a ticket dispenser according to one of the several embodiments of the present invention.

As was described above, because the rollers 114*a–c* and output roller 118 are disposed substantially near or in abutment with the driver 104 during operation, the driver guide 110 (see FIG. 4) facilitates the movement of the ticket strip 20 with the surface 138 of the driver 104 as the driver 104 rotates. More specifically, the rollers 114*a–c* and output roller 118 can facilitate holding the ticket strip 20 in contact with the pins 136. The shape of the rollers 114*a–c* of the driver guide 110 can further facilitate piercing of at least a portion of the thickness T of the ticket strip 20 by the pins 136. For example, as shown in FIG. 6, one of rollers 114*a–c* can include a groove 140 around a circumference of the roller. The groove 140 can be aligned with the pins 136, such that as the driver 104 rotates, the pins 136 pass through the groove 140 of the roller. Thus, as a ticket strip 20 passes between the driver 104 and the roller, the pins 136 can more easily pass through at least a portion of the thickness of the ticket strip 120. Further, with the groove 140 included in the roller, the pins 136 are less likely to contact the rollers, thereby resulting in less drag imparted to the driver 104. With less drag, the driver 104 can operate more efficiently and at greater speeds. Additionally, because the rollers 114*a–c* are free to rotate, even less drag is imparted to the ticket strip 20. This further reduces the tension on the ticket strip and likelihood of damage thereof For reasons that will soon become apparent, the driver 104 is equipped with a pair of grooves 143 flanking the pins 136.

Figure 7:
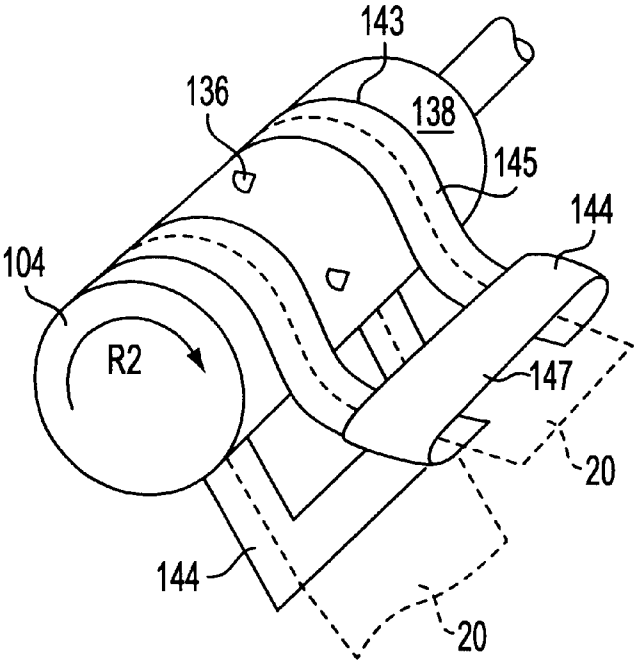
FIG. 7 is a detail view of a drive roller and a guide roller of the ticket dispenser, according to an embodiment of the present invention.

The driver 104 is shown in FIG. 7 in conjunction with an output guide 144. The output guide is formed of a hard material such as metal or plastic and extends around at least a portion of the circumference of the driver 104. The output guide 144 is fixedly connected to the base 82 (see FIG. 4) and the driver 104 is free to rotate relative to the output guide 144. Ideally, the output guide 144 remains within the grooves 143 in order to minimize friction with respect to the ticket strip 20. In one embodiment, only a ¼ inch center portion of the ticket engages the drive roller 104. In the alternative, such width may be thinner, while ¼ inch engagement is ideal for a ½ inch ticket strip 20. The output guide 144 can assist the direction of the dispensed tickets toward an output of the game apparatus. Ideally, the output guide 144 is positioned such that the ticket strip 20 is outputted just above a door opening of the game apparatus 26. Further, the output guide 144 can also help ensure that the ticket strip 20 passes around the drive 104 in the direction of rotation R2, thereby helping to avoid ticket jams. While the output guide 144 is shown to include a pair of elements 145 coupled via an connector 147, such connector 147 may be excluded.

Figure 8:
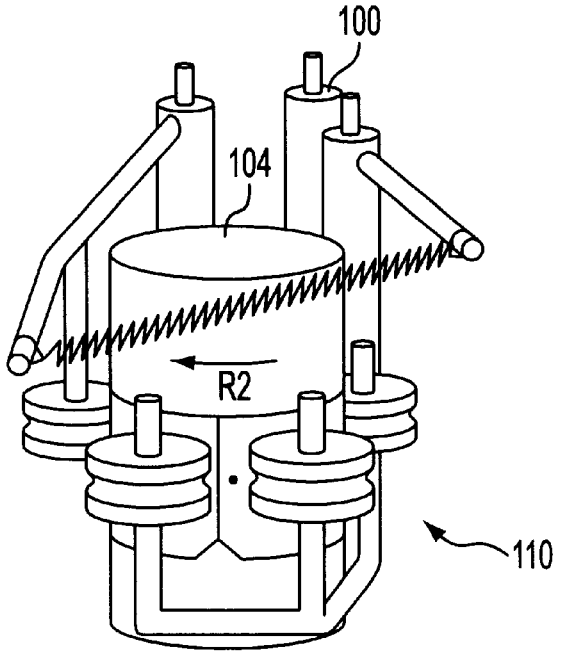
FIG. 8 is a perspective view of a guide and drive assembly of the ticket dispenser of FIGS. 4 and 5, according to an embodiment of the present invention.

FIG. 8 shows a perspective view of a ticket strip 20 passing between the driver 104 and the driver guide 110. As can be seen, as the driver 104 rotates in the direction of the arrow R2, the pins 136 penetrate at least a portion of the thickness of the ticket strip 20 and pass through the grooves 140 of the rollers 114*a–c*. Similarly, the output roller 118 can also include a groove 140 through which the pins 136 can pass. Thus, the pins that have pierced the ticket strip, carry or pull the ticket strip 20 in the same direction of rotation indicated by the arrow R2. In this way, the ticket strip 20 is pulled along the ticket path 88 and output from the ticket dispenser 72. Such pulling along the ticket path 88 can thereby result in fewer jams of the ticket strip 20 than if the ticket strip 20 was pushed along the ticket path 88. Further, with the reduced tension on the ticket strip due to the rotatability of the output roller 118, the rollers 114*a–c*, and the front guide 100, the ticket strip 20 can experience fewer rips, tears, and other damage.

Figure 9:
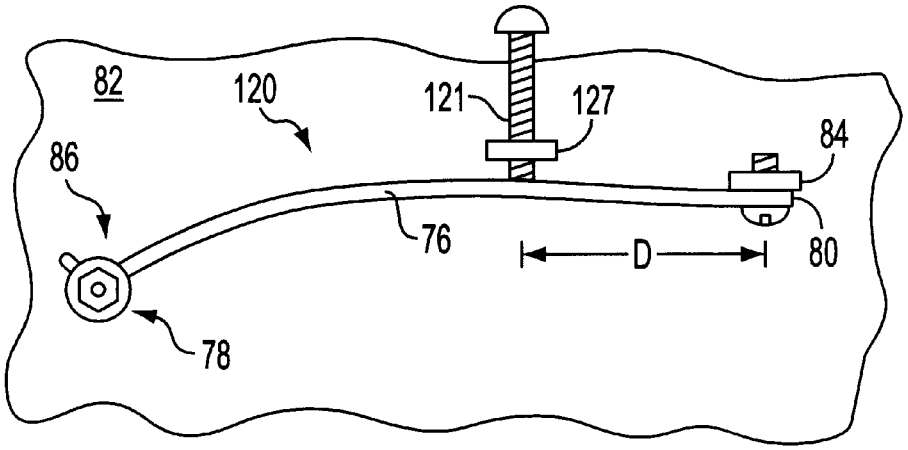
FIG. 9 is a side view of a tension device, according to an embodiment of the present invention.

FIG. 9 shows a tension device 120 having an adjustable tension. As with the tension device 74 shown in FIG. 4, the tension device 120 includes a tension spring 76 and a rear guide 78. A fixed end 80 of the tension spring 76 is fixedly connected to the base 82, and a free end 86 is presses against the rear guide 78. In addition, a screw 121 is disposed adjacent the tension spring 76, at a distance D away from the fixed end 80. For example, such a screw 121 can pass through an extension 127 that is fixedly attached to the base 82. Further, the screw 121 can be turned to exert more or less pressure on the tension spring, thereby moving the free end 86 of the tension spring 76 closer to or further away from the rear guide 78. Thus, the force with which the tension spring 76 presses against the rear guide 78 during operation of the ticket dispenser 72 can be easily adjusted, for example to accommodate different thickness or types of ticket strips. Further, varying widths of the ticket strips may be accommodated by adjusting constraints of the rear guide 78.

In use, the ability to tear the ticket strip 20 at the output end of the ticket dispenser 34 is dependent on an amount of pressure exerted by the tension spring 76 and the drag of the ticket dispenser 34 relative to the strength of the perforation of the ticket strip 20. The adjustment of the tension spring 76 should be below the threshold of the perforation or the ticket strip 20 may tear within the ticket dispenser 34. If the resistance within the ticket dispenser 34 is 3 ounces and the strength of the perforation is 5 ounces, the pressure exerted by the tension spring 76 should be greater than 2 ounces and less than approximately 4 ounces. It should be noted that resistance is mainly afforded within the rollers. As an option, the tension spring 76 may be adjusted via the screw 121 while running the ticket strip 20 until the perforation tears between the tension spring 76 and the drive roller 104. Thereafter, it is beneficial to decrease the tension spring 76 slightly.

Figure 10:
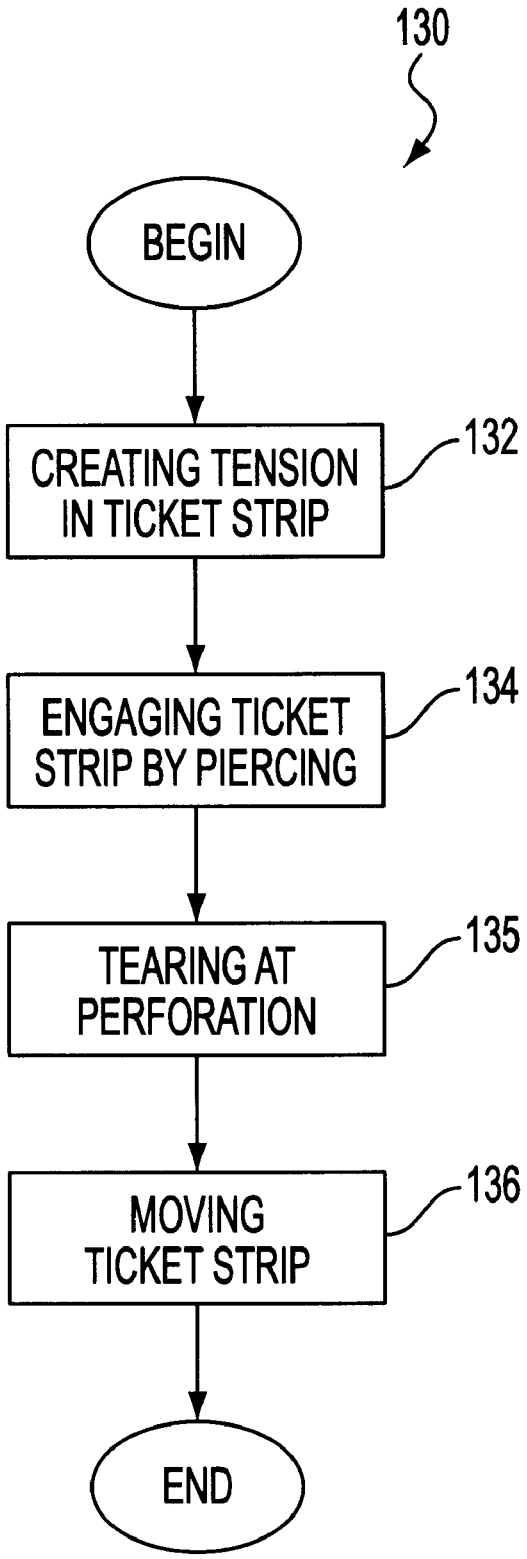
FIG. 10 is a process diagram of a method for dispensing tickets, according to an embodiment of the present invention.

FIG. 10 is a process diagram of a method 130 for dispensing tickets from an apparatus. While not shown, method 130 begins with feeding the ticket strip 20 by placing an end in the driver 104 and pressing a button on the game apparatus 26. Thereafter, the ticket strip 20 is maneuvered under the tension spring 76. Method 130 includes creating tension in a ticket strip in operation 132. This can be facilitated by pressing the ticket strip between two objects to impart a frictional force in the opposite direction of the movement of the ticket strip. For example, such force can be imparted by a tension spring that presses against a guide. In operation 134, the ticket strip is engaged by piercing the ticket strip. The ticket strip can be pierced at one or more pierced points at one time, for example at three pierced points. Such piercing can include pressing a sharp pin into the ticket strip. This can be accomplished by passing the ticket strip between a guide and a driver which includes at least one sharp pin. Further, the piercing can be facilitated by passing the sharp pin through a groove in the guide as the ticket strip passes between the groove and the sharp pin. In operation 135, the ticket strip is manually torn at a perforation.

The method 130 further includes moving the ticket strip in operation 136. This moving can include translating the pierced points along the ticket path. The ticket strip can be moved by moving the sharp pin. In particular, this can be done by rotating a cylinder on which surface the sharp pin is located. By moving the ticket strip in this way, less tension is necessary in the ticket strip to dispense the ticket strip. Thus, the likelihood of separating, tearing, ripping, or otherwise damaging the ticket strip is reduced over that with ticket dispensers of the prior art. Further, thinner ticket strips, or those with less tensile strength can be used with this method more effectively than with ticket dispensers of the prior art.

In summary, the present invention provides structures and methods for dispensing tickets with a wide range of thickness, sizes and at high speeds, while reducing the likelihood of tearing, ripping, or otherwise damaging the tickets and the likelihood of jamming the ticket dispenser. The invention has been described herein in terms of several preferred embodiments. Other embodiments of the invention, including alternatives, modifications, permutations and equivalents of the embodiments described herein, will be apparent to those skilled in the art from consideration of the specification, study of the drawings, and practice of the invention. For example, the ticket dispenser of the present invention described herein can be used for a wide variety of applications in which a number of tickets are dispensed to users who can exchange the tickets for goods or services. Further, the ticket dispenser can include or be used in conjunction with other components, including those described in U.S. Pat. No. 5,695,107 to S. P. Shoemaker, Jr., the description of which is incorporated herein by reference. The embodiments and preferred features described above should be considered exemplary, with the invention being defined by the appended claims, which therefore include all such alternatives, modifications, permutations and equivalents as fall within the true spirit and scope of the present invention.

What is claimed is:

1. A ticket dispenser for outputting tickets through an outlet of an apparatus, said ticket dispenser comprising:

a base having a first end and a second end, wherein said second end is disposed near an outlet of an apparatus;

a tension device disposed near said first end of said base and configured to frictionally engage a ticket strip when said ticket strip is moved through said tension device, wherein said tension device includes a rear guide and a flexible tension spring aligned with and pressed toward said rear guide, said tension device being adjustable;

a driver disposed near said second end of said base, having at least one sharp protrusion, wherein said driver is configured to rotate independently from said base and to engage and move said ticket strip away from said tension device along a ticket path and said at least one sharp protrusion is configured to pierce at least a portion of a thickness of said ticket strip when said driver engages said ticket strip;

a rotatable driver guide roller having a generally cylindrical shape with a groove around a circumference of said driver guide roller, wherein said at least one sharp protrusion on said driver is aligned with said groove, and said driver guide roller is rotatable coupled to an arm which is rotatable coupled to said base; and a second roller rotatably coupled to a second arm which is rotatable coupled to said base, wherein a spring is coupled between said arms for biasing said driver guide roller and said second roller against said driver.

2. The ticket dispenser as recited in claim 1, further comprising:

a sensor adjacent said ticket path, which includes a plurality of individual tickets, and configured to detect each of said individual tickets when each of said individual tickets passes by said sensor.

3. The ticket dispenser as recited in claim 1, wherein said driver and said driver guide roller are constructed from nylon.

4. The ticket dispenser as recited in claim 1, further comprising an output guide extending from said driver and toward said outlet of said apparatus.

5. The ticket dispenser as recited in claim 1, and further comprising a mid-path guide positioned between said driver and said tension device.

6. The ticket dispenser as recited in claim 5, and further comprising a front guide positioned along said ticket path between said driver and said mid-path guide.

7. The ticket dispenser as recited in claim 1, wherein said rollers reside on diametrically opposed sides of said driver.

8. The ticket dispenser as recited in claim 1, wherein a plurality of driver guide rollers are rotatably coupled to said arm for being biased against said driver about a circumference thereof.

9. The ticket dispenser as recited in claim 1, further comprising means for rotating said driver.

10. A method for dispensing a ticket strip from an apparatus, said method comprising:

creating tension in a ticket strip with a tension device including a rear guide and a flexible tension spring aligned with and pressed toward said rear guide, said tension device being adjustable;

engaging said ticket strip by piercing said ticket strip at at least one point, wherein said piercing said ticket strip includes using a driver having a sharp pin that pierces into said ticket strip, at least one rotatable driver guide roller rotatably coupled to an arm and having a generally cylindrical shape with a groove around a circumference of said driver guide roller, wherein said at least one sharp pin on said driver is aligned with said groove, and a second roller rotatable coupled to a second arm, wherein a spring is coupled between said arms for biasing said driver guide roller and said second roller against said driver; and translating said pierced point along a ticket path, wherein said translation contributes to said creating tension in said ticket strip.

11. The method for dispensing a ticket strip from an apparatus as recited in claim 10, further comprising sensing a quantity of tickets that are dispensed.

12. The method for dispensing a ticket strip from an apparatus as recited in claim 11, further comprising guiding said ticket strip in contact with said sharp pin.

13. A ticket dispenser for dispensing a ticket strip from an apparatus, said ticket dispenser comprising:

a base having a first end and a second end, wherein said second end is disposed near an outlet of an apparatus;

a tension device disposed near said first end of said base and configured to frictionally engage a ticket strip when said ticket strip is moved through said tension device, wherein the tension device is adjustable;

a driver disposed near said second end of said base, having at least one sharp protrusion, wherein said driver is configured to rotate independently from said base and to engage and move said ticket strip away from said tension device along a ticket path and said at least one sharp protrusion is configured to pierce at least a portion of a thickness of said ticket strip when said driver engages said ticket strip; and a driver guide in close proximity to said driver around at least a portion of a circumference of said driver, said driver guide including a pair elements which encompass said driver.

14. The ticket dispenser for dispensing a ticket strip from an apparatus as recited in claim 13, wherein said driver includes a pair of concentric grooves which flank said protrusion, said elements of said driver guide being situated in the concentric grooves for maintaining said ticket strip in abutment with said sharp protrusion.

15. The ticket dispenser for dispensing a ticket strip from an apparatus as recited in claim 14, and further comprising a rotatable driver guide roller having a generally cylindrical shape with a groove around a circumference of said driver guide roller, wherein said at least one sharp protrusion on said driver is aligned with said groove, and said driver guide roller has a width substantially equal to a distance between said concentric grooves.

* * * * *